US009266644B2

(12) United States Patent
Kadish

(10) Patent No.: US 9,266,644 B2
(45) Date of Patent: Feb. 23, 2016

(54) APPARATUS FOR MULTI-ACTIVIY ATHLETIC EVENT TRANSITION AND METHOD FOR MAKING THE SAME

(71) Applicant: Aram Kadish, Santa Monica, CA (US)

(72) Inventor: Aram Kadish, Santa Monica, CA (US)

( * ) Notice: Subject to any disclaimer, the term of this patent is extended or adjusted under 35 U.S.C. 154(b) by 0 days.

(21) Appl. No.: 13/839,532

(22) Filed: Mar. 15, 2013

(65) Prior Publication Data

US 2013/0213836 A1 Aug. 22, 2013

(51) Int. Cl.

| | |
|---|---|
| ***A47B 61/06*** | (2006.01) |
| ***B65D 25/00*** | (2006.01) |
| ***A47G 25/84*** | (2006.01) |
| ***A63B 71/00*** | (2006.01) |

(52) U.S. Cl.

CPC ..... *B65D 25/00* (2013.01); *A47G 25/84* (2013.01); *A63B 71/0036* (2013.01); *A63B 2209/10* (2013.01); *A63B 2225/68* (2013.01); *A63B 2244/00* (2013.01); *Y10T 29/49826* (2015.01); *Y10T 29/53* (2015.01)

(58) Field of Classification Search

CPC .... B65D 85/18; B65D 85/182; A61B 19/045; A47G 25/54; A45C 3/12

USPC ..... 206/278, 287.1, 289, 292, 294, 298, 206/320; 190/102, 106, 108, 110, 119, 13 R, 190/16; 211/34, 35, 37, 85.3, 440, 576, 211/610, 638, 675

See application file for complete search history.

(56) References Cited

U.S. PATENT DOCUMENTS

| | | | | |
|---|---|---|---|---|
| 3,139,164 | A * | 6/1964 | Koffler | A45C 3/004 190/119 |
| 4,170,282 | A * | 10/1979 | Schwartzstein | A45C 7/0086 190/108 |
| 4,190,918 | A | 3/1980 | Harvell | |
| 4,240,480 | A | 12/1980 | Strobel | |
| 4,819,570 | A * | 4/1989 | Bailet | E05G 5/00 109/23 |
| 4,863,003 | A | 9/1989 | Carter | |
| 5,178,310 | A | 1/1993 | Sowerby | |
| 5,641,199 | A | 6/1997 | Bond-Madsen | |
| 5,927,575 | A | 7/1999 | Gatling | |
| 5,938,336 | A | 8/1999 | King | |
| 5,943,936 | A * | 8/1999 | Deliman | A45C 13/262 16/113.1 |

(Continued)

*Primary Examiner* — Fenn Matthew
*Assistant Examiner* — Cynthia Collado
(74) *Attorney, Agent, or Firm* — Nadia Akaweih; Rachelle Law; Hollie Kucera

(57) ABSTRACT

This application describes an athletic activity transition device for use during multi-activity athletic events (to include decathlons, duathlons, biathlons, x-terra and other multi sporting activities that require transitioning between the various sporting activities) to minimize the time expended by an athlete during transitions from one athletic activity to the next. The disclosure is directed specifically to the device's blades which are used to carry athletic gear—specifically shoes, and are designed to be oriented in such a way to facilitate quick and efficient access to the gear when transitioning between athletic activities. The athletic activity transition device further provides a stable platform on which the athlete can sit during the changing process, thus allowing a brief rest period and saving time and energy otherwise wasted while trying to balance changing shoes and other gear in a standing position.

9 Claims, 15 Drawing Sheets

(56) References Cited

U.S. PATENT DOCUMENTS

| | | | | |
|---|---|---|---|---|
| 6,244,481 | B1 | 6/2001 | Brougher | |
| 6,367,674 | B1 | 4/2002 | Tabor | |
| 2001/0015365 | A1 | 8/2001 | Flynn | |
| 2003/0006258 | A1 | 1/2003 | Flynn | |
| 2004/0089683 | A1 | 5/2004 | Theodore | |
| 2004/0118891 | A1 | 6/2004 | Esqueda | |
| 2004/0149793 | A1 | 8/2004 | Theodore | |
| 2005/0224304 | A1* | 10/2005 | Bhavnani | A45C 7/0077 190/107 |
| 2008/0011567 | A1* | 1/2008 | Hammond | A45C 7/009 190/108 |
| 2011/0121044 | A1 | 5/2011 | Schopf | |

* cited by examiner

11/15

13/15

APPARATUS FOR MULTI-ACTIVIY ATHLETIC EVENT TRANSITION AND METHOD FOR MAKING THE SAME

BACKGROUND

1. Field of the Application

The disclosure is directed to an athletic activity transition device to be used during multi-activity athletic events—specifically for transitioning between the multiple athletic activities.

2. Background of the Disclosure

Multi-activity athletic events can include, but are not limited to triathlons, decathlons, duathlons, biathlons or any other athletic event which involves transitioning between one or more activities such as swimming, cycling, skiing and running. A triathlon for example is a timed, non-stop sequence of swimming, running, and cycling events, each having its own equipment. Inherent in a triathlon are two transitions, where the triathlete completes once event and begins another. During the transition phase of a race, competitors typically either stand, unbalanced on one foot at a time, while trying to remove their wetsuit and put on their socks and shoes, or sit on the ground in the sand and dirt. This typical transitioning can take up extra time and further exhaust the athlete, as well as expose the athlete to potential dangers, such as losing balance and falling while changing on one foot. Minimizing transition times is the goal of every triathlete, as is transitioning as safely as possible.

Traditionally, athletes used sports bags simply to transport sports equipment and clothing; therefore, their utility was in their ability to move the greatest amount of equipment with the least effort to and from the athletic event, as opposed to being an active part of the sport, playing a direct role in the athlete's performance. Athletes have a lot of gear to carry around to and from each race. They often have to carry backpacks, bags and other containers long distances to the race site while riding their bikes. These bags get in the way and take up precious space within their assigned transition slot. Each competitor typically carries a wetsuit, goggles, socks, bike shoes, running shoes, bike helmet, sunglasses, race paperwork, sunscreen, other body creams, bike maintenance tools/supplies, food and drinks, change of clothes, and numerous other materials plus their bicycle.

Therefore what is needed is an athletic activity transition device that plays an active role in increasing overall speed and efficiency of athletes by making the transition process safer and less burdensome.

BRIEF SUMMARY

In certain embodiments, an athletic activity transition device includes a container configured for use during a multi-activity athletic event including one or more athletic transition activities to facilitate transitioning from one athletic activity to the next; and one or more blades coupled to one or more outer surfaces of the container and configured to receive athletic equipment for use during the one or more athletic transition activities.

In certain embodiments, a method of making an athletic activity transition device includes obtaining a container suitable for athletic activity transition device, waterproofing the container and coupling one or more blades suitable for holding athletic equipment to one or more outer surfaces of the container.

In certain embodiments, an apparatus for making an athletic activity transition device includes means for obtaining a container suitable for athletic activity transition device, means for waterproofing the container and means for coupling one or more blades suitable for holding athletic equipment to one or more outer surfaces of the container

BRIEF DESCRIPTION OF THE DRAWINGS

The accompanying drawings, which are incorporated in and constitute a part of this specification, illustrate various exemplary embodiments of the present disclosure:

FIG. 7A illustrates an exemplary enlarged view of a proximal end of a blade according to certain embodiments;

FIG. 7B illustrates an exemplary enlarged view of a proximal end of a blade according to certain embodiments;

DETAILED DESCRIPTION

Figure 1:
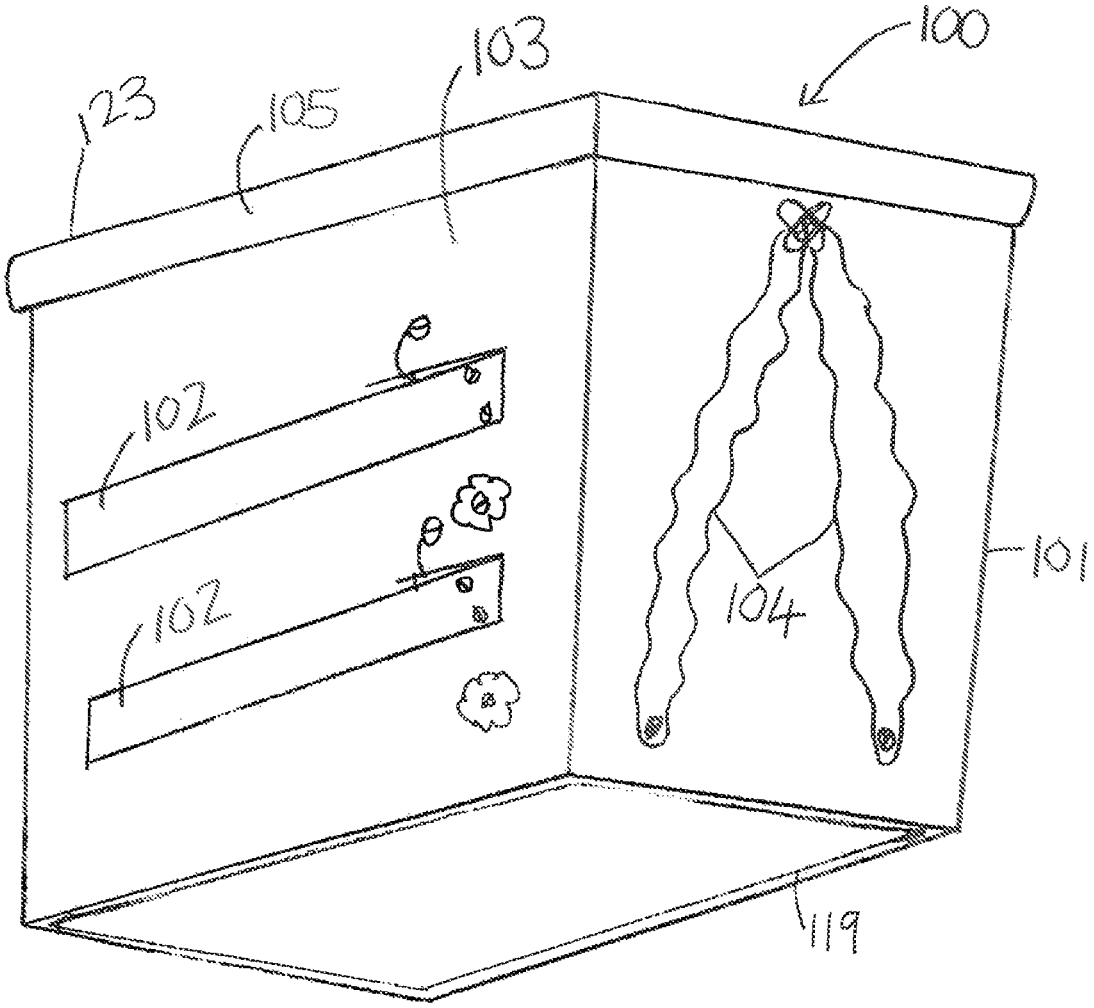
FIG. 1 illustrates an exemplary isometric view from the bottom of an athletic activity transition device according to certain embodiments.

The following detailed description is directed to certain exemplary embodiments. However, the disclosure can be embodied in a multitude of different ways as defined and covered by the claims and equivalents thereof. In this description, reference is made to the drawings wherein like parts are designated with like reference numerals throughout.

FIG. 1 illustrates an exemplary isometric view from the bottom of an athletic activity transition device 100 according to certain embodiments. As shown in FIG. 1, transition device 100 is illustrated with straps 104 coupled to an outer surface 103 of the device and two blades 102 coupled to another outer surface of the device. As shown in FIG. 1, exemplary athletic activity transition device 100 generally includes a container 101; one or more blades 102 positioned on one or more outer surfaces 103 of container 101 which are configured to receive and carry athletic gear such as shoes. Container 101 may also have straps 104 which are coupled to outer surface 103 of container 101 and can be used by the athlete to carry athletic activity transition device 100 to or from the event while the athlete engages in various athletic activities. In certain embodiments, container 101 has a lid 105 on a top surface 123 which may be opened and through which dry and wet gear may be loaded into the container 101. Additionally, lid 105 may alternatively be located on any other outer surface of the container to provide an opening through which gear can be loaded. Lid 105 may be coupled to top surface 123 or any other side or bottom surface desirable using a roller hinge or any other hinging mechanism. In certain embodiments, lid 105 may alternatively be coupled to top surface 123 or any other side or bottom surface by rails that interlock with the sliding lid and act as a guide upon which lid 105 will slide to the open and closed positions.

As further shown in FIG. 1 athletic activity transition device 100 with container 101 can be used by an athlete during multi-activity athletic events to store one or more athletic equipment and athletic gear and facilitate transitioning from one athletic activity to the next. According to certain embodiments, container 101 can be formed of plastic and/or coated with a water resistant material. Alternatively, container 101 may be made of other materials including, but not limited to wood, glass, plexi-glass, fiberglass and the like, all of which may be coated and/or lined (e.g., with plastic) to aid in corrosion prevention and water resistance. Container 101 may also be made of one or more metals including but not limited to iron, copper, steel, aluminum, rubber, tin, or any similar materials brush coated with aluminum or any other water/rust resistant material. In certain embodiments, container 101 measures a length of approximately 16 inches, a width of approximately 11 inches, and a height of approximately 18 inches. Additionally, these measurements may be varied in order to suit the user's needs and/or engineering/manufacturing constraints and container 101 may be configured without straps 104.

Figure 2:
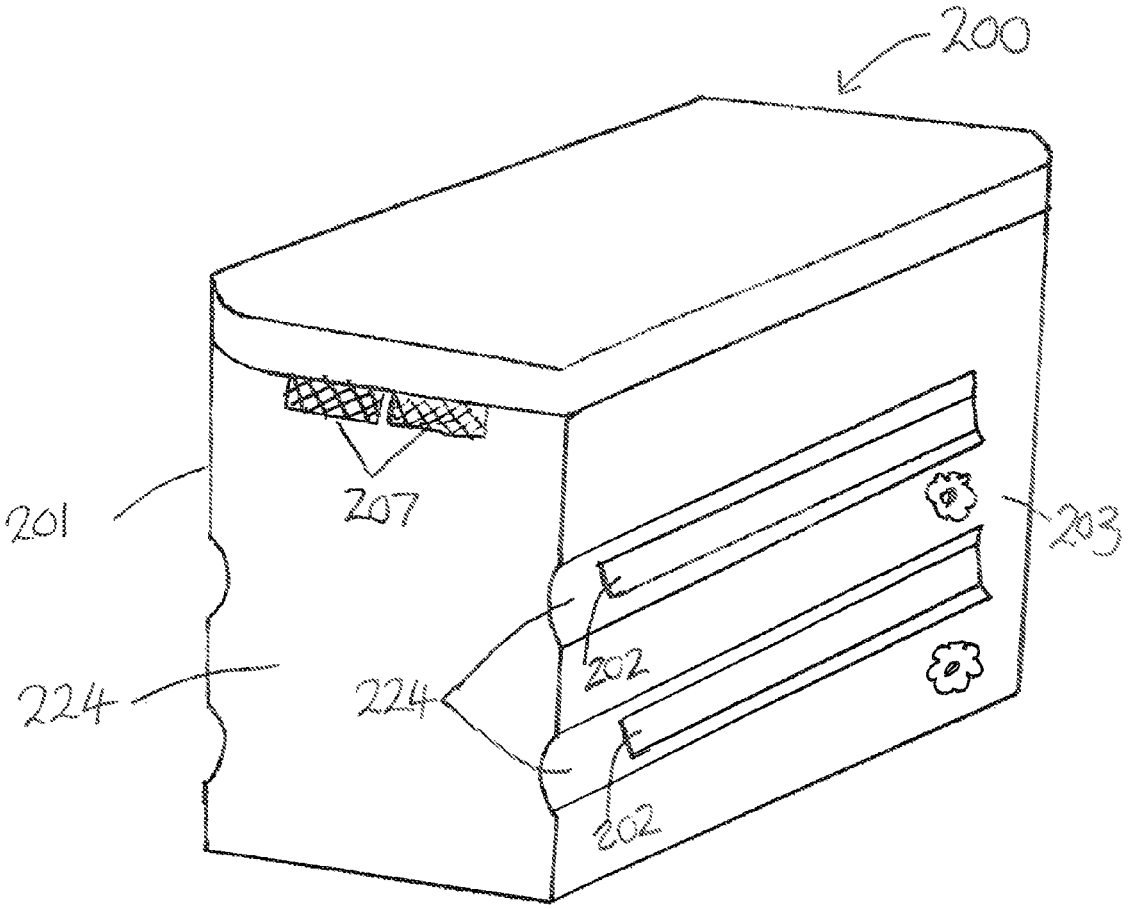
FIG. 2 illustrates an exemplary isometric view from the top of an athletic activity transition device according to certain embodiments.

FIG. 2 illustrates an exemplary isometric view from the top of an athletic activity transition device 200 according to certain embodiments. As shown in FIG. 2, transition device 200 can have one or more blades 202 coupled to an outer surface with recessed walls 203, and polyester/nylon hook-and-loop fastener strips 207 coupled to another outer surface of the device 224 according to certain embodiments. As shown in FIG. 2, outer surface with recessed walls 203 of device 200 to which blades 202 are coupled has a concave recessed area 222 that allows shoes or other athletic gear stored on the blades to be partially or fully lodged in concave recessed area 222. In certain embodiments, concave recessed area 222 runs horizontally along the length of outer surface with recessed walls 203 of device 200 and measures approximately 2-3 inches deep with a diameter of approximately 6 inches. Alternatively, concave recessed area 222 can be tapered along the horizontal length of outer surface with recessed walls 203 towards the proximal ends of blades 202 so as to allow concave recessed area 222 to only be partially recessed, or not recessed at all at the proximal end of blades 202 and for the recession to become larger towards the distal end of blades 202. Device 200 may also alternatively be configured with a flat outer surface 103 as in FIG. 1, or with a plurality of polyester/nylon hook-and-loop fastener strips 207 or with no polyester/nylon hook-and-loop fastener strips 207 according to certain embodiments.

Figure 3:
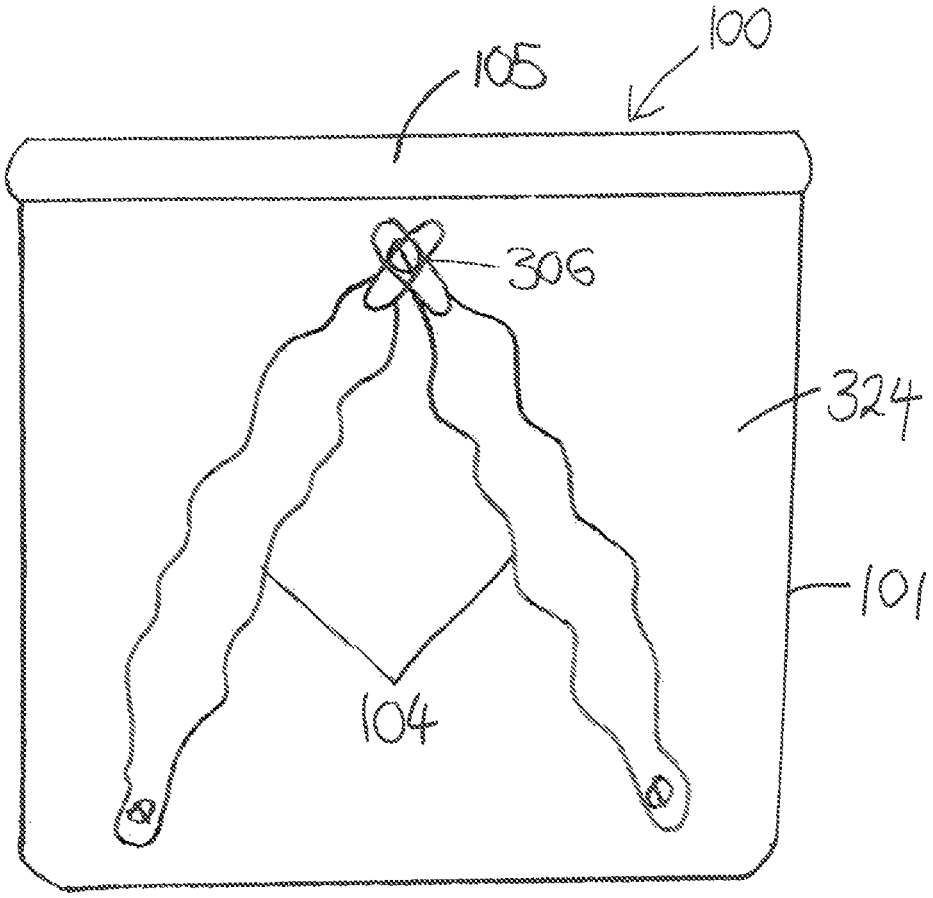
FIG. 3 illustrates an exemplary front view of an athletic activity transition device according to certain embodiments.

FIG. 3 illustrates an exemplary front view of athletic activity transition device 100 according to certain embodiments. As shown in FIG. 3, transition device 100 can be configured with straps 104 and lid 105 in a closed position according to certain embodiments. Alternatively, lid 105 may be located on one of the outer surfaces, including, but not limited to surface 224 as shown in FIG. 2 or surface 103 as shown in FIG. 1. As illustrated in FIG. 3, straps 104 are coupled to at least one outer surface, e.g. 324 of container 101 by a threaded screw, bolt, rivet or any similar fastener 306 inserted through a similarly threaded hole on an outer surface, e.g. 324 of container 301 and locked in place. Additionally, device 101 can be configured without straps 104 or straps 104 may be coupled to outer surface 324 of device 100 in a non-fixed manner for easy removal.

Figure 4:
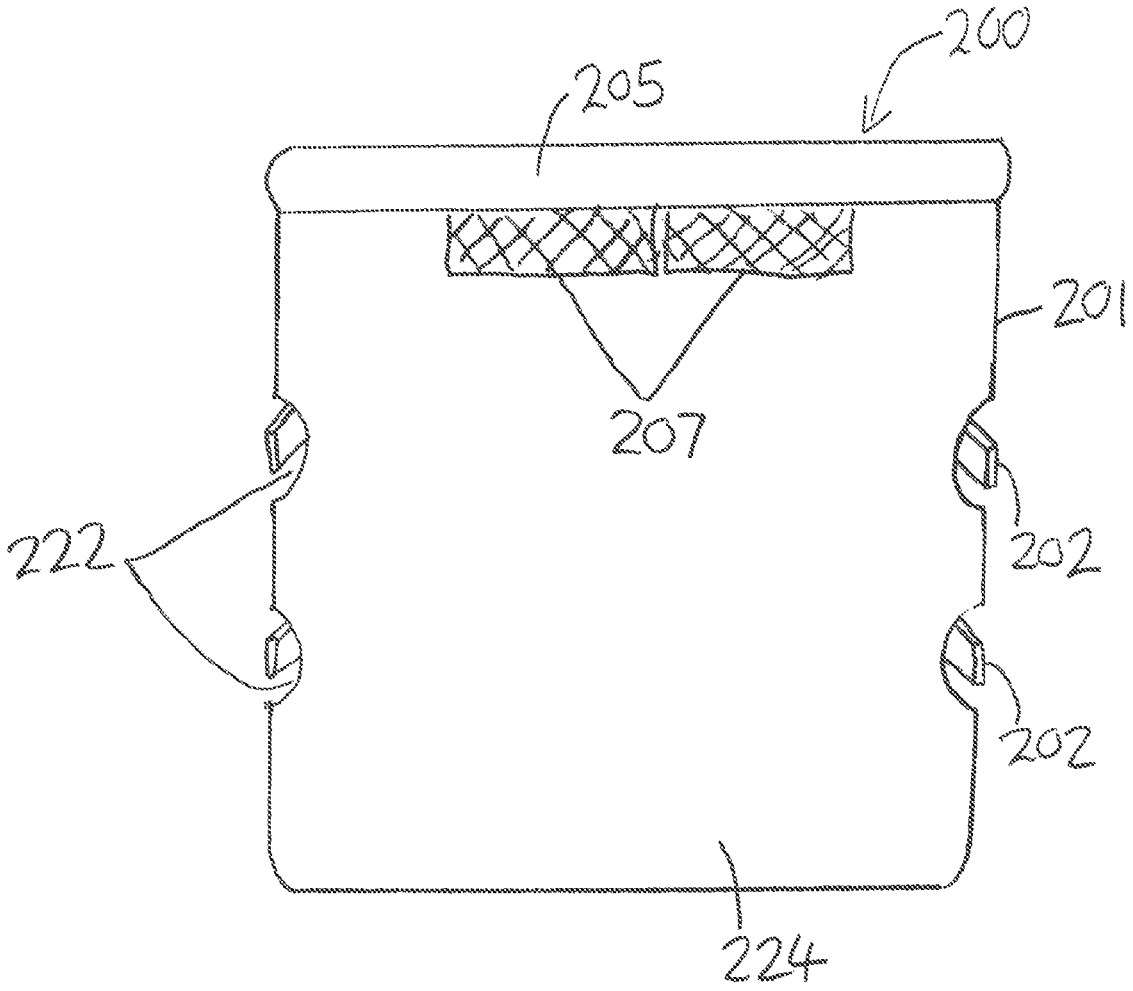
FIG. 4 illustrates an exemplary back view of an athletic activity transition device according to certain embodiments.

FIG. 4 illustrates an exemplary back view of athletic activity transition device 200 according to certain embodiments. As shown in FIG. 4, transition device 200 may be configured with polyester/nylon hook-and-loop fastener strips 207 which may be coupled to outer surface 224 of container 201, one or more blades 202 with distal ends partially lodged in concave recessed area 222, and lid 205 of device 200 in a closed position according to certain embodiments. One or more blades 202 may be tapered towards the distal end so as to provide a better fit for shoes or any other athletic gear to be carried thereon. In certain embodiments, polyester/nylon hook-and-loop fastener strips 207 are coupled to the container 201 by an adhesive configured to stick on any glass, plastic, or metal surface of which container 201 may be made or on any water/rust resistant coating with which the container may be coated. Fastener strips 207 are to allow for a mat configured with a similar nylon/polyester hook-and-loop surface to be coupled to container 101 for use during transition.

Figure 5:
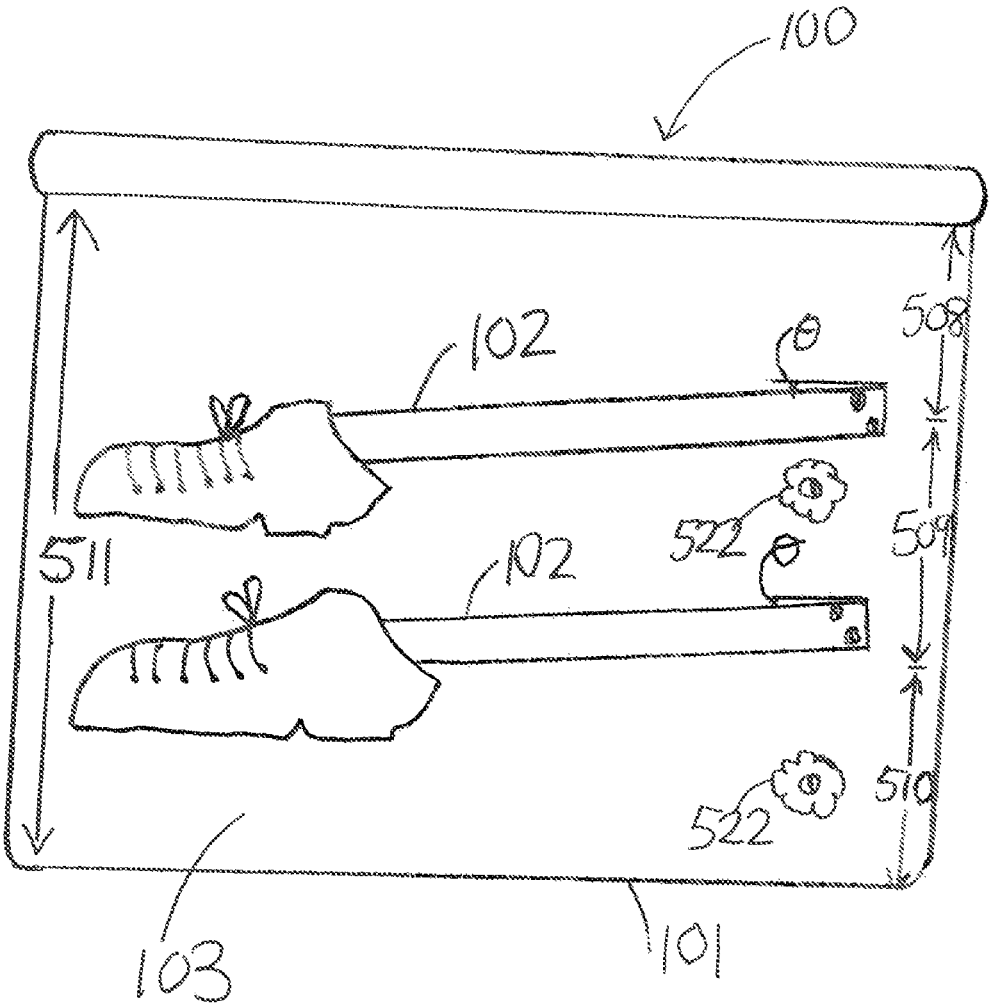
FIG. 5 illustrates an exemplary right side view of an athletic activity transition device according to certain embodiments.

FIG. 5 illustrates an exemplary right side view of an athletic activity transition device according to certain embodiments. As shown in FIG. 5, transition device 100 may be configured with two blades 102 in a fixed, predetermined position on outer surface 103 of device 100 for athletic shoes to be carried thereon, and one or more accessory connectors 522, such as, for example, those used to hold a towel. In certain embodiments, one or more blades 102 are positioned in such a way that their position is adjustable along one or more outer surfaces 103 of container 101. Additionally, one or more blades 102 can be positioned at predetermined distances 508, 509, and 510 based on the size of the athletic gear to be received and stored on blades 102. Blades 102 can be positioned along a vertical height 511 of one or more outer surfaces 103 of container 101. In certain embodiments, one or more blades 102 can be positioned at fixed predetermined distances of ⅓ and ⅔ respectively along height 511 of the surface to which they are coupled. Additionally, blades 102 may be positioned at variable predetermined positions along one or more outer surfaces 103 of container 101.

Figure 6:
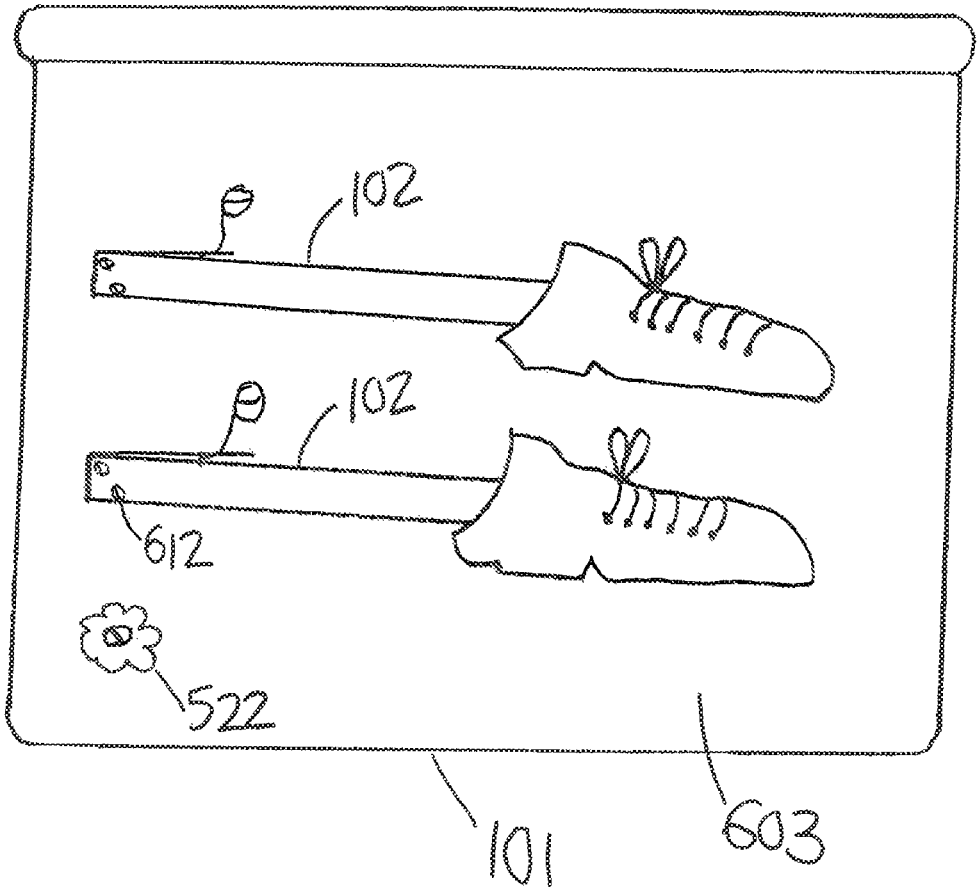
FIG. 6 illustrates an exemplary left side view of an athletic activity transition device according to certain embodiments.

FIG. 6 illustrates an exemplary left side view of an athletic activity transition device 100 according to certain embodiments. As shown in FIG. 6, transition device 100 may be configured with two blades 102 in a fixed, predetermined position on a right side outer surface 603 of device 100 for athletic shoes to be carried thereon. In certain embodiments, one or more blades 102 can be coupled in a fixed manner to one or more outer surfaces of container 101 by a threaded screw, bolt, rivet or any similar fastener 612 inserted through a similarly threaded hole on an outer surface 603 of container 101 and locked in place. Alternatively, one or more blades 102 may also be coupled in a fixed manner to container 101 by an adhesive, an ultrasonic weld or any similar plastic or metal fusion/welding process. In certain embodiments, one or more blades 102 may also be removable and coupled in an adjustable manner by a magnet or a slot cut across the horizontal length, or vertical width of outer surface 603 of container 101 through which one or more blades 102 may be placed at different positions and fastened by a threaded screw, bolt or any similar fastener 612.

FIG. 6 additionally illustrates one or more exemplary accessory connectors 522 which are located on an outer surface 603 of the container for ease of reach during transitioning between athletic activities according to certain embodiments. As shown in FIG. 6, accessory connectors 522 may be positioned on any one or more outer surfaces of container 101 in order to hang towels in a convenient and easily accessible location.

Figure 7:
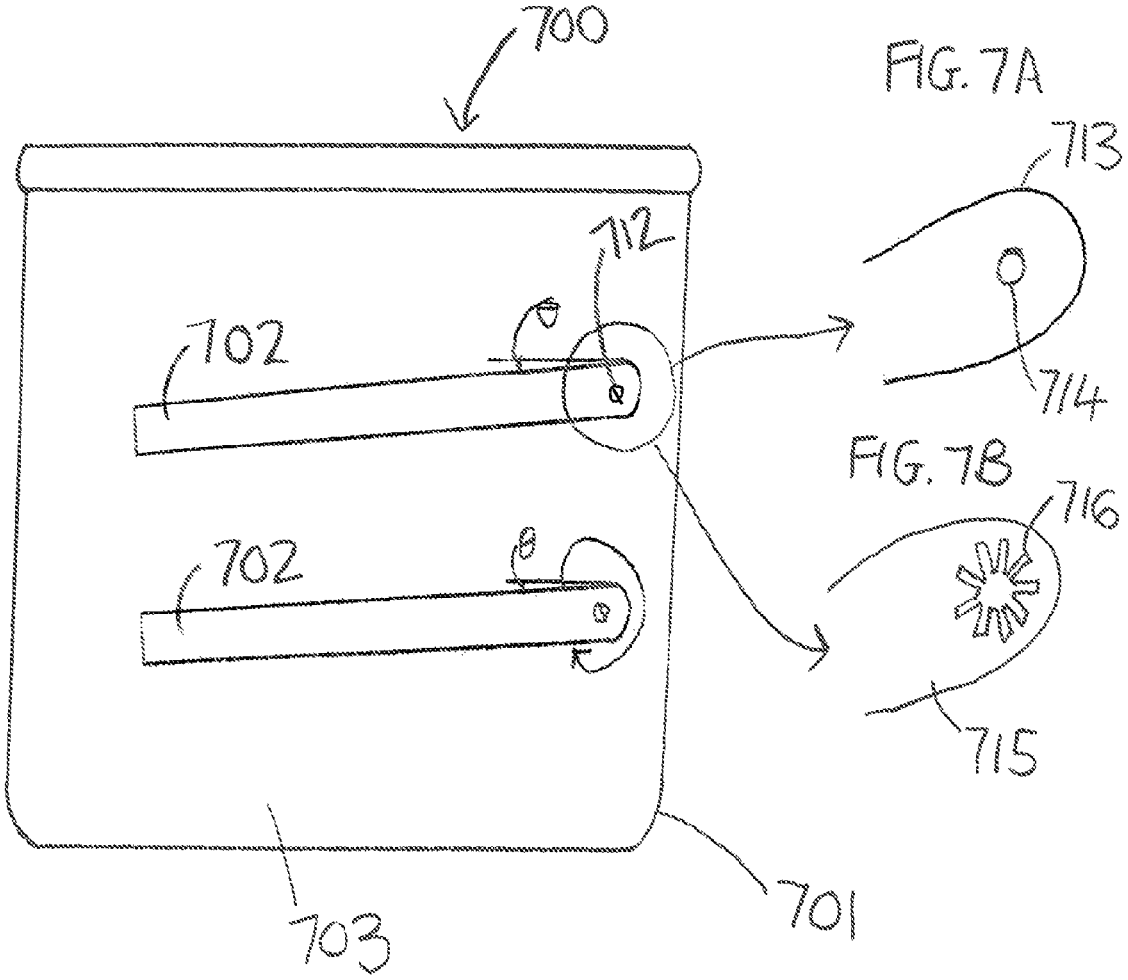
FIG. 7 illustrates an exemplary side view of an athletic activity transition device according to certain embodiments.

FIG. 7 illustrates an exemplary side view of an athletic activity transition device 700 according to certain embodiments. As shown in FIG. 7, transition device 700 can be configured with two blades 702 in an adjustable position. FIG. 7A illustrates an exemplary enlarged view of a proximal end of blade 702 according to certain embodiments. As shown in FIG. 7A, blades 702 can be configured with a proximal end shaped as a round disk 713 with a hole 714 in the center. FIG. 7B illustrates an exemplary enlarged view of a proximal end of blade 702 according to certain embodiments. As shown in FIG. 7B, blades 702 can be configured with proximal end shaped as round disk 713 with a flat inner portion 715 of the disk 713 that mates with an outer surface 703 of grooved container 701 having grooves 716 radiating from the center according to certain embodiments. As shown in FIGS. 7, 7A and 7B, flat inner portion 715 of the disk that mates against outer surface 703 of grooved container 701 has grooves 716 radiating from the center. In certain embodiments, grooves 716 allow disk 713 to firmly grip outer surface 703 of container 701 without allowing it to rotate unless an attaching screw, bolt or any similar fastener 712 is loosened and blade 702 grooves 716 are moved away from the matching grooves on outer surface 703 of grooved container 701. Hole 714 would allow a screw to be inserted through outer surface 703 of grooved container 701 and round disk 713 portion of one or more blades 702.

In certain embodiments, one or more blades 702 are oriented in a substantially horizontal manner. FIG. 7 illustrates one or more blades 702 coupled to outer surface 703 of container 701 at an angle $\theta=15°$. Alternatively angle $\theta$ may be varied to suit a user's need for example $\theta=+/-10°$, or $\theta=+/-5°$, or $\theta=+/-20°$. In certain embodiments one or more blades 702 may alternatively be oriented vertically.

Figure 8:
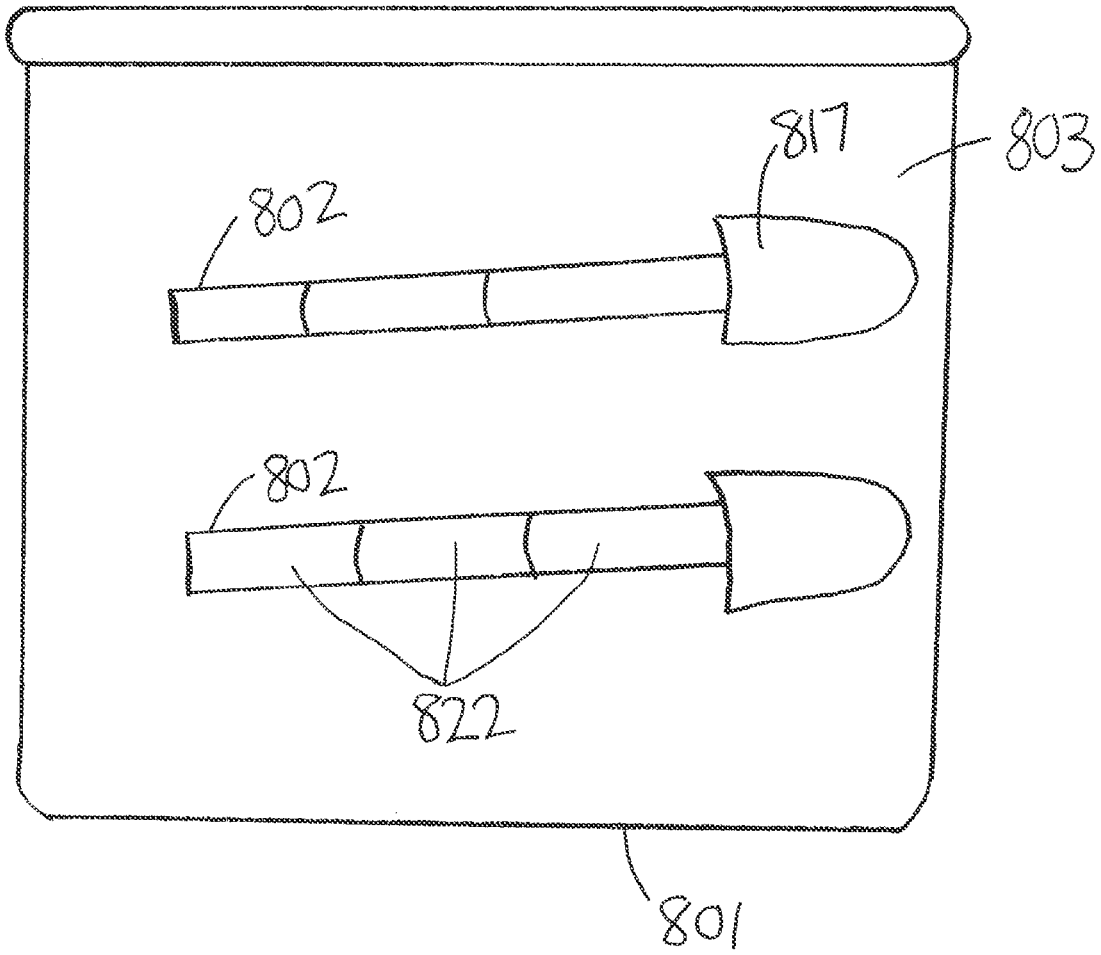
FIG. 8 illustrates an exemplary side view of an athletic activity transition device according to certain embodiments.

FIG. 8 illustrates an exemplary side view of an athletic activity transition device 800 according to certain embodiments. As shown in FIG. 8, transition device 800 can be configured with one or more adjustable blades 802 coupled to pocketed container 801 by sliding into pockets 817 which are positioned on an outer surface 803 of container 801. In certain embodiments, one or more blades 802 are configured in such a way that the length is adjustable in which each blade 802 is made of a plurality of sections 822 where each section can be retractable into an adjacent section so as to vary the total length of each blade 802 thereby allowing for receiving and carrying different sizes of athletic gear. One or more blades 802 can have a length of approximately 12 inches, a width of approximately 1.5-2 inches and a thickness of approximately ⅜ inches. Alternatively, the length, width and thickness of blades 802 may be varied in proportion to the size of the shoe or other athletic gear to be carried thereon and to suit user need.

In certain embodiments, one or more blades 802 can be made of plastic. Alternatively, one or more blades 802 can be made of other suitable materials including, but not limited to wood with a plastic liner for corrosion resistance, glass, plexiglass, fiberglass or metals including but not limited to iron, copper, steel, aluminum, rubber, tin, or any similar materials brush coated with aluminum or any other water/rust resistant material.

As shown in FIG. 8, one or more blades 802 are shaped as a straight line terminating in a straight edge. Alternatively, one or more blades 802 can have any other shape including, but not limited to a curved s-shape, or u-shape, or step or zigzag pattern and said blades terminating in curved, or semicircle, or conical or spherical shape.

According to certain embodiments, one or more blades 802 are coupled to container 801 at the proximal end, and free/detached from container 801 at the distal end. Alternatively, the one or more blades 802 may be attachable to container 801 at the distal end through a magnet, an adhesive or other mechanism to engage the distal end of one or more blades 802 with the container so as to prevent the athletic gear from falling off blades 802 during athletic activities. In certain embodiments, one or more blades 802 can be made of plastic, or any other suitable materials including, but not limited to wood with or without a plastic liner for corrosion resistance, glass, plexi-glass, fiberglass or metals including but not limited to iron, copper, steel, aluminum, rubber, tin, or any similar materials brush coated with aluminum or any other water/rust resistant material. Furthermore, the shape of one or more blades 802 can be varied so as to be a cylindrical rod with a corresponding diameter. In certain embodiments, blades 802 can be coupled to pocketed container 801 with a separate connector having holes on the side corresponding with holes on blades 802 so as to allow blades 802 to be held in place on pocketed container 801 with a set-screw.

Figure 9A:
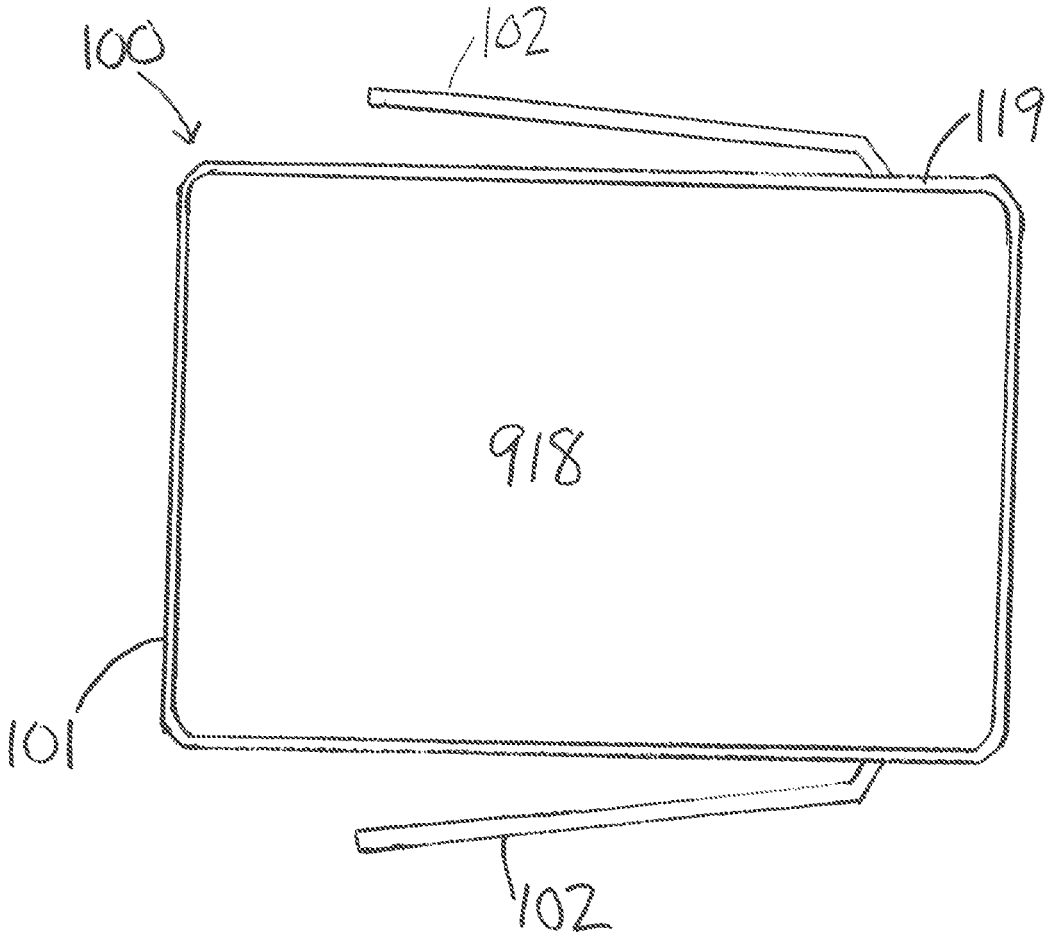
FIG. 9A illustrates an exemplary bottom view of an athletic activity transition device according to certain embodiments.
Figure 9B:
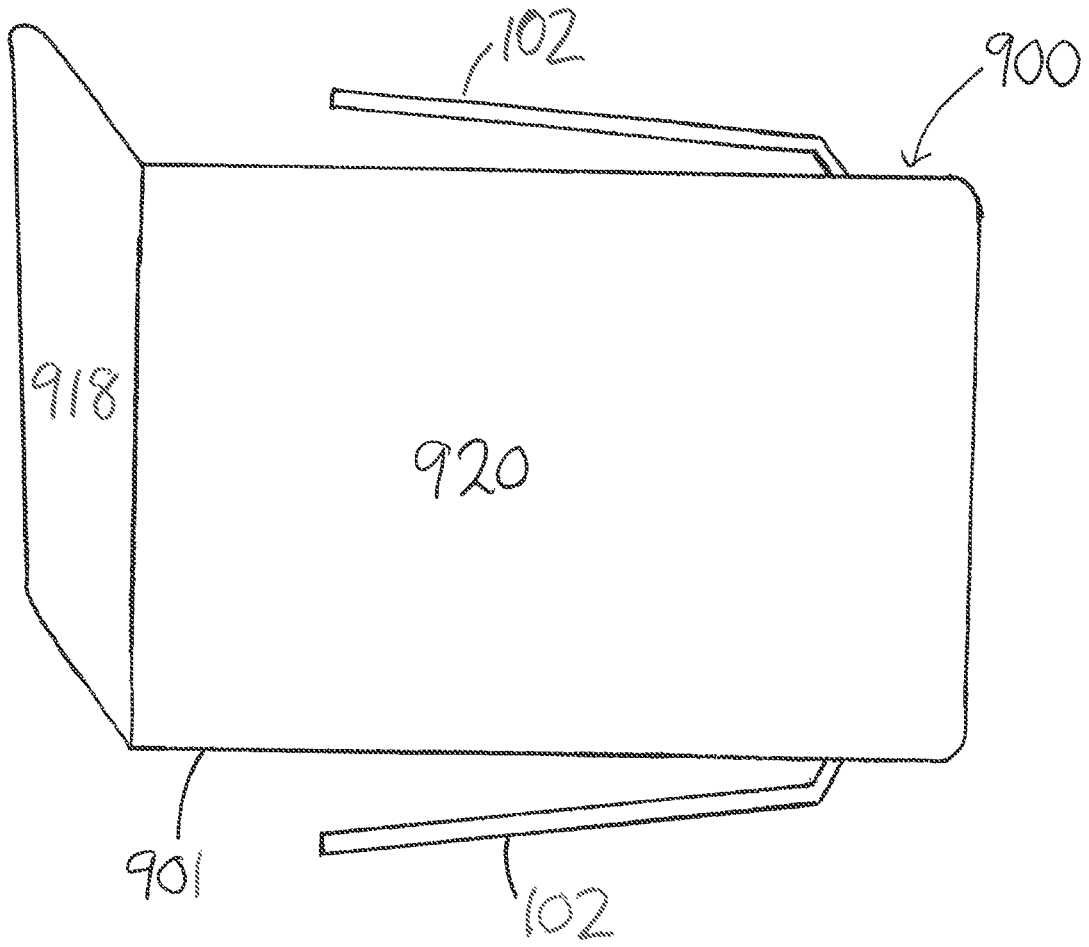
FIG. 9B illustrates an exemplary bottom view of an athletic activity transition device according to certain embodiments.

FIG. 9A illustrates an exemplary bottom view athletic activity transition device 100 according to certain embodiments. As shown in FIG. 9A transition device 100 can be configured with one or more blades 102 coupled to container 101 and a bottom surface 918 additionally having a slightly elevated lip 919 around the perimeter. Slightly elevated lip 919 can extend across the entire outer perimeter of bottom surface 918 and provide additional support for the athlete to press his/her foot against as he/she puts on shoes or other athletic gear and ties up laces. FIG. 9B illustrates an exemplary bottom view of an athletic activity transition 900 device according to certain embodiments. As shown in FIG. 9B transition device 900 can be configured with a bottom surface 918 that further functions as a lid in its open position and is coupled to a second bottom surface 920 by being pivoted from an edge of second bottom surface 920. As shown, FIGS. 9A and 9B illustrate bottom surface 918 of bottom-lidded container 901 on which the athlete may sit in order to facilitate quick and stable changing of gear when transitioning between activities. According to certain embodiments, bottom surface 918 may be cushioned on both sides, i.e., in either the open or closed position to provide comfort for the athlete whether the athlete uses bottom surface 918 as a seat or as a back rest while changing. Alternatively, second bottom surface 920 may also be configured with a slightly elevated lip around the perimeter to provide additional leverage for the athlete to press his shoes against during changing. Furthermore, bottom surface/lid 918 may be configured without a cushion on one or both sides, or the transition device may be configured without a lid coupled to second bottom surface 920 thus leaving only one bottom surface according to certain embodiments.

Figure 10:
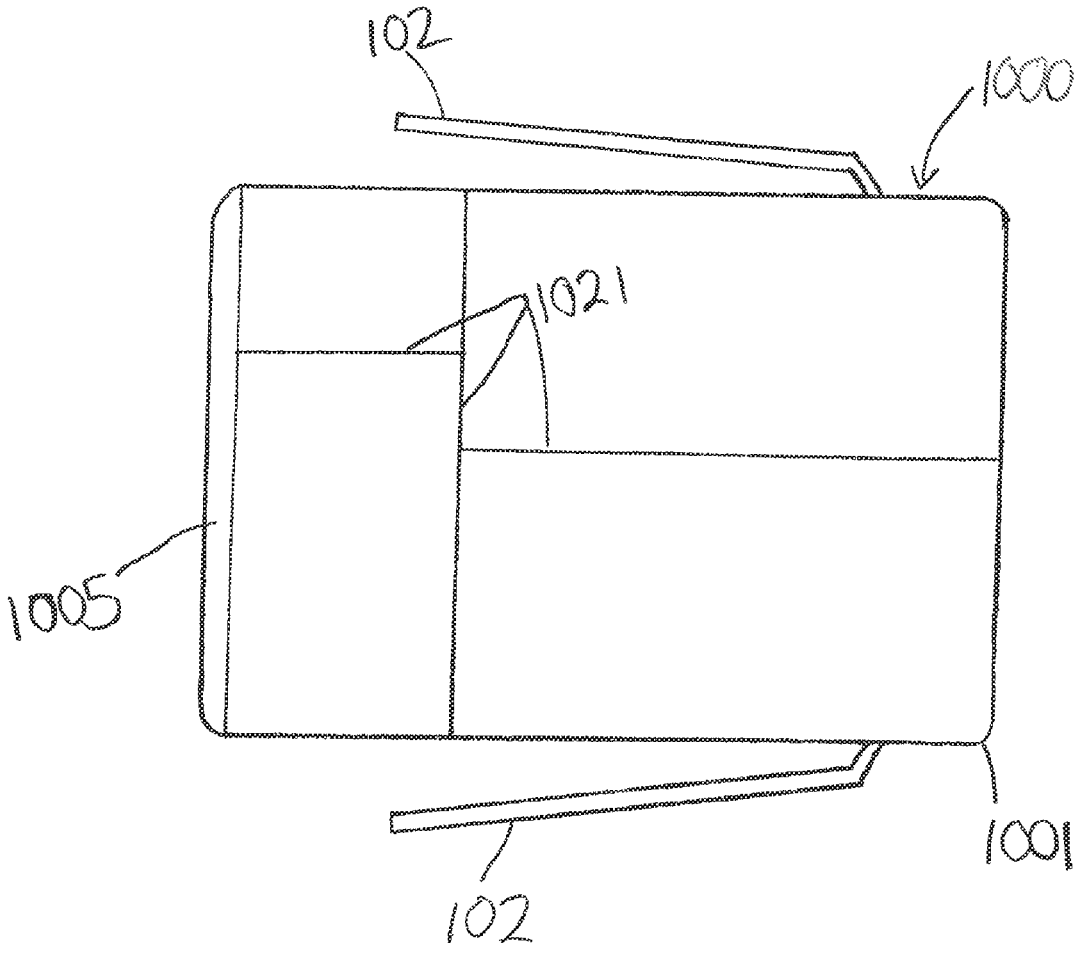
FIG. 10 illustrates an exemplary top view of an athletic activity transition device according to certain embodiments.

FIG. 10 illustrates an exemplary top view of an athletic activity transition device 1000 according to certain embodiments. As shown in FIG. 10, transition device 1000 is configured with a lid 1005 coupled to a top surface of segmented container 1001 in an open position to illustrate division of the interior of container 1001 into a plurality of vertically oriented segments/compartments 1021. The compartments 1021 can be used for storage and separation of wet and dry materials, can be made of the same plastic material as the container 1001 and can be fixed within container 1001. According to certain embodiments, compartments 1021 can be removable and made of other waterproof/rust resistant materials including but not limited to rubber, glass, plexiglass, or materials coated with waterproof substances to prevent rusting when wet materials are placed therein. Compartments 1021 may also have mesh as a separator. Alternatively, compartments 1021 may be separated using wood with a plastic liner, or any other metal material brush coated in aluminum to prevent rust. As shown in FIG. 10, compartments 1021 are oriented vertically. Alternatively, compartments 1021 may be oriented so that container 1001 is segmented horizontally.

Figure 11A:
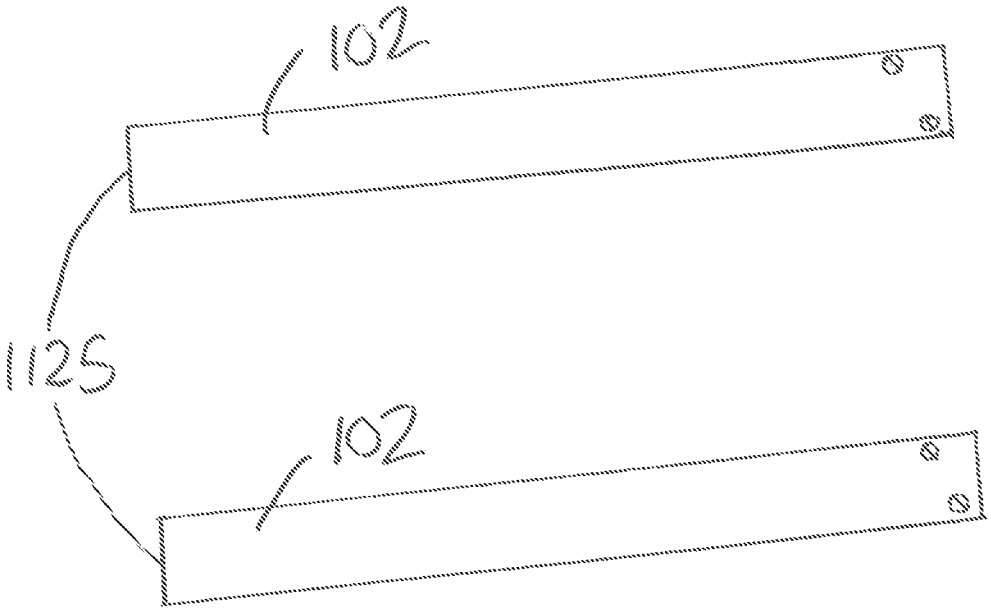
FIG. 11A illustrates an exemplary view of distal ends of blades according to certain embodiments.
Figure 11B:
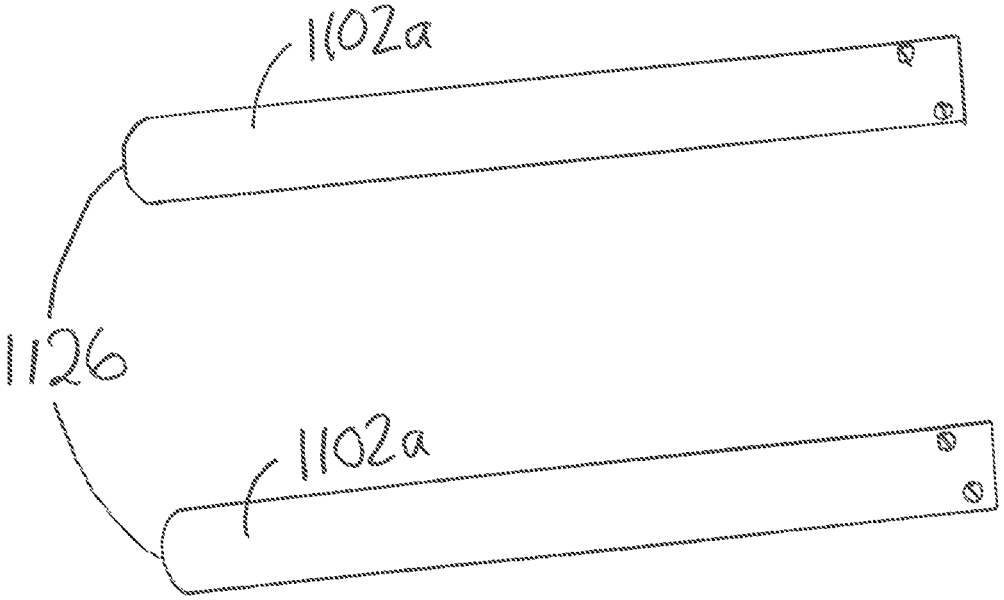
FIG. 11B illustrates an exemplary view of distal ends of blades according to certain embodiments.
Figure 11C:
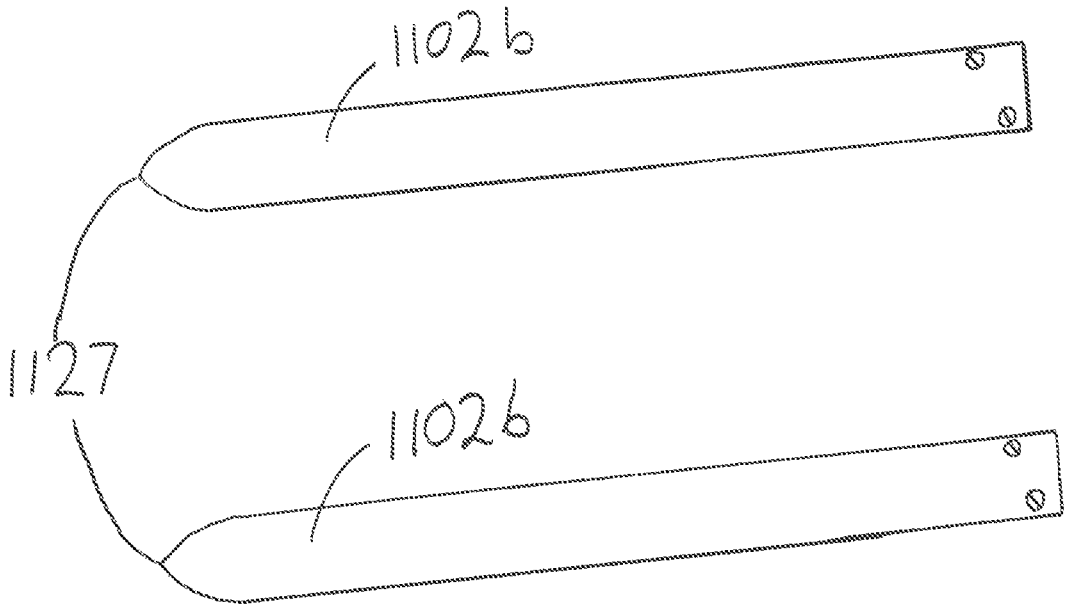
FIG. 11C illustrates an exemplary view of distal ends of blades according to certain embodiments.

FIG. 11A illustrates an exemplary view of distal ends of blades 102 according to certain embodiments. As shown in FIG. 11A distal ends of blades 102 can be shaped as a flat edge 1125 in order to accommodate the athletic gear to be carried thereon. FIG. 11B illustrates an exemplary view of distal ends of blades according to certain embodiments. As shown in FIG. 11B distal end of blades 1102*a* can be shaped in a circular manner 1126 in order to accommodate the athletic gear to be carried thereon. FIG. 11C illustrates an exemplary view of distal ends of blades 1102*b* according to certain embodiments. As shown in FIG. 11C distal ends of blades 1102*b* can be shaped in a conical manner 1127 in order to accommodate the athletic gear to be carried thereon. As shown in FIGS. 11A, 11B and 11C there are a plurality of ways in which distal ends of one or more blades 102, 1102*a*, or 1102*b* may be shaped in order to accommodate the athletic gear to be carried thereon—for example a shoe. As shown in FIG. 11A, the distal end of one or more blades 102 may be a straight edge 1125. Alternatively, as shown in FIG. 11B the distal end of one or more blades 1102*a* may be circular 1126; or as shown in FIG. 11C one or more blades 1102*b* may be conical 1127. Alternatively, the distal end of the blade may have any other shape suitable for carrying athletic gear/shoes.

Figure 12:
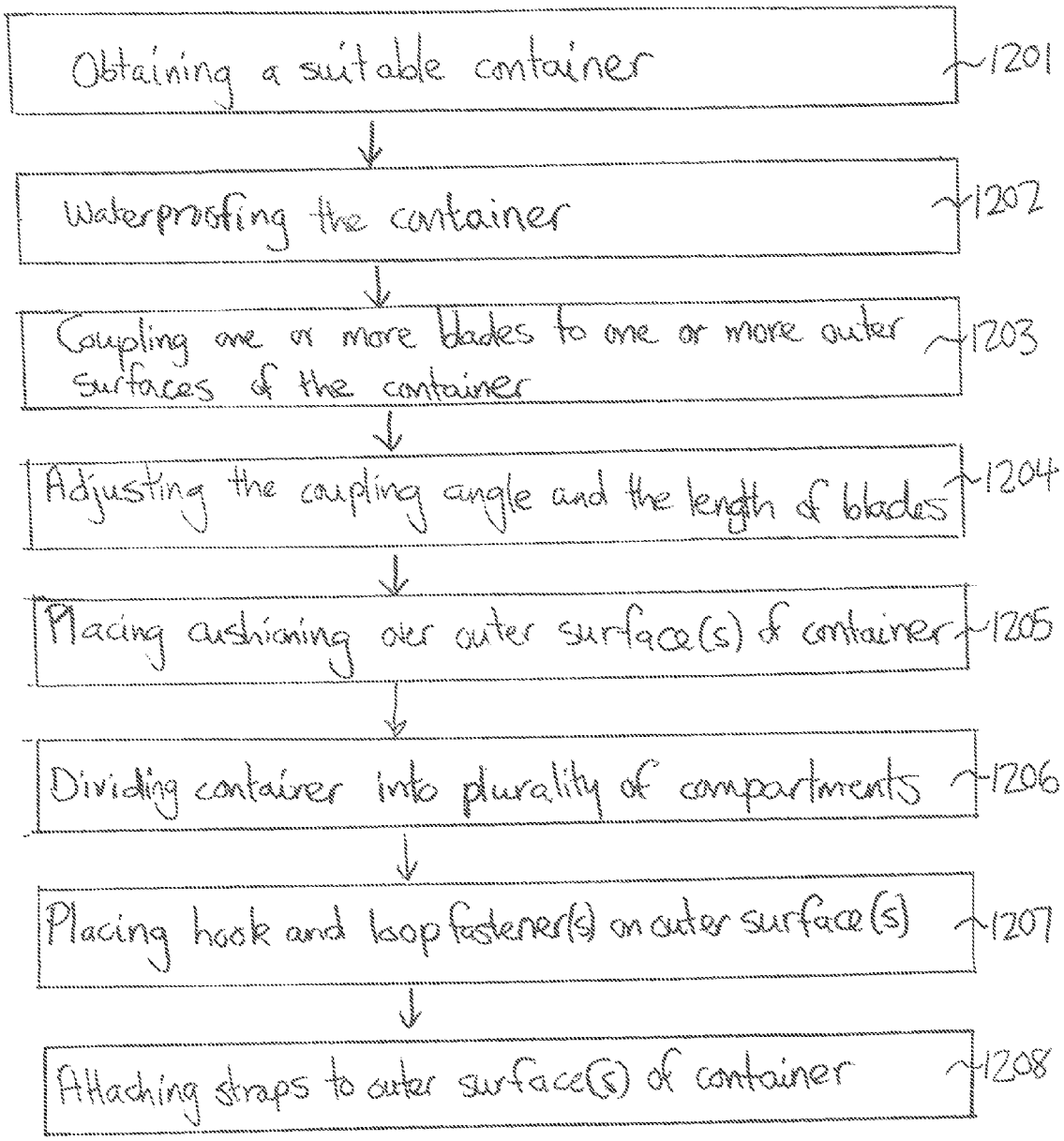
FIG. 12 illustrates an exemplary flowchart for making/manufacturing an athletic activity transition device according to certain embodiments.

FIG. 12 illustrates an exemplary flowchart for making an athletic activity transition device according to certain embodiments, including:

A step 1201 of procuring or constructing a container. The procured container may be made of plastic or any of the materials described in FIG. 1 including, but not limited to wood with a plastic liner for corrosion resistance, glass, plexiglass, and fiberglass. Alternatively, the container can also be made of one or more metals including but not limited to iron, copper, steel, aluminum, rubber, tin, or any similar materials brush coated with aluminum or any other water/rust resistant material. According to certain embodiments, the container can be formed of plastic or coated with a water resistant material. The container can measure a length of approximately 16 inches, a width of approximately 11 inches, and a height of approximately 18 inches. Additionally, these measurements may be varied in order to suit the user's needs.

According to certain embodiments, the container may alternatively be constructed through injection molding or any other similar material molding process including, but not limited to extrusion blow molding, injection blow molding, stretch blow molding, compression molding, extrusion molding, matrix molding, or thermoforming and molded into the desired shape suitable for athletic activity transition device.

A step 1202 of coating waterproofing the container. The waterproof lining or material is to prevent athletic gear stored in the device from getting wet and rusting and protect it from wet outside weather conditions. Alternatively, if the container obtained is already waterproof then this step may be omitted.

A step 1203 of coupling one or more blades suitable for holding athletic equipment to one or more outer surfaces of the container. According to certain embodiments one or more blades are made of plastic, or one or more blades may be made by molding plastic or any of the materials described below into the desired shape. Alternatively, one or more blades may be made of other suitable materials including, but not limited to wood with or without a plastic liner for corrosion resistance, glass, plexi-glass, fiberglass or metals including but not limited to iron, copper, steel, aluminum, rubber, tin, or any similar materials brush coated with aluminum or any other water/rust resistant material.

According to certain embodiments, one or more blades may be coupled as described in FIG. 5 either in a fixed manner to one or more outer surfaces of the container by a threaded screw, bolt, rivet or any similar fastener inserted through a similarly threaded hole on an outer surface of the container and locked in place. Alternatively, one or more blades may also be coupled in a fixed manner to the container by a an adhesive, an ultrasonic weld or any similar plastic or metal fusion/welding process. According to certain embodiments, one or more blades may also be removable and coupled in an adjustable manner by a magnet or a slot cut across the width of an outer surface of the container through which one or more blades may be placed at different positions and fastened by a threaded screw, bolt or any similar fastener.

A step 1204 of adjusting a coupling angle and a length of one or more blades. According to certain embodiments, as shown in FIG. 8, one or more blades may be configured in such a way that the length is adjustable in which each blade 802 is made of a plurality of sections 822 where each section can be retractable into an adjacent section so as to vary the total length of each blade 802 thereby allowing for receiving and carrying different sizes of athletic gear. One or more blades can have a length of approximately 12 inches, a width of approximately 1.5-2 inches and a thickness of approximately ⅜ inches. Alternatively, the length, width and thickness of the blades may be varied in proportion to the size of the shoe or other athletic gear to be carried thereon and to suit user need.

According to certain embodiments, one or more blades may be oriented in a substantially horizontal manner as shown in FIG. 7 which illustrates one or more blades coupled at an angle $\theta=15°$. Alternatively the angle being may be varied to suit a user's need for example $\theta=+/-10°$, or $\theta=+/-5°$, or $\theta=+/-20°$. According to certain embodiments one or more blades may be oriented vertically as well.

A step 1205 of placing cushioning over at least one outer surface of the container. This step is optional and may be omitted if not desired by the user. Furthermore, this step may be performed in any order after the container is obtained.

A step 1206 of dividing the inside of the container to create a plurality of either vertical or horizontal compartments in order to allow for separation of wet and dry materials. This step is optional and may be performed in any order after obtaining the container. As shown in FIG. 10, the compartments are for storage and separation of wet and dry materials and may be made of the same plastic material as the container and may be fixed within the container. According to certain embodiments, the compartments may be removable and made of other waterproof/rust resistant materials such as rubber, glass, plexi-glass, or materials coated with waterproof substances to prevent rusting when wet materials are placed therein. Some compartments may also have mesh as a separator. Alternatively, the compartments may be separated using wood with a plastic liner, or wood or any other metal material brush coated in aluminum to prevent rust. As shown in FIG. 10, the compartments are oriented vertically. In certain embodiments, the compartments may be oriented so that the container is segmented horizontally.

A step 1207 of placing a hook and loop fastener on at least one surface for attaching a mat onto the container which will be easy to reach during transition activities. In certain embodiments a nylon/polyester hook and loop fasteners are used. This step is optional and may be performed in any order after constructing or procuring the container.

A step 1208 of attaching straps to at least one outer surface of the container by a screw, bolt, rivet or any similar fastener inserted through an aligned hole in the outer surface of the container. This step is optional and may be performed in any order after constructing or procuring the container.

EMBODIMENTS

1. An athletic activity transition device comprising:

a container configured for use during a multi-activity athletic event including one or more athletic transition activities to facilitate transitioning from one athletic activity to the next; and one or more blades coupled to one or more outer surfaces of the container and configured to receive athletic equipment for use during the one or more athletic transition activities.

2. The transition device of claim 1, wherein the one or more blades extend from a proximate end coupled to the container to a distal end.

3. The transition device of claim 1, wherein the container includes a collapsible internal frame and one or more flexible outer surfaces.

4. The transition device of claim 1, wherein the container is a rigid, hard shell container.

5. The transition device of claim 1, wherein the one or more outer surfaces to which the one or more blades are coupled has a concave recessed area that runs horizontally along the length of the outer surface and the athletic equipment includes shoes stored on the one or more blades and lodged in at least a portion of the recessed area.

6. The transition device of claim 1, wherein the one or more blades are removable from the container and the one or more blades are adjustably coupled to the one or more outer surfaces of the container.

7. The transition device of claim 6, wherein angles of the one or more blades relative to horizontal are adjustable in a rotatable manner.

8. The transition device of claim 1, wherein the two or more blades are positioned at a predetermined distance with respect to each other.

9. The transition device of claim 1, wherein two or more blades are positioned on two or more outer surfaces of the container.

10. The transition device of claim 1, wherein the container further comprises straps coupled to an outer surface of the container.

11. The transition device of claim 1, wherein the container further comprises hook-and-loop fastener strips coupled to an outer surface of the container.

12. The transition device of claim 1, further including one or more inner dividers.

13. A method of making an athletic activity transition device, the method comprising:

obtaining a container suitable for athletic activity transition device;

waterproofing the container; and coupling one or more blades suitable for holding athletic equipment to one or more outer surfaces of the container.

14. The method of claim 13 further comprising:

adjusting a coupling angle and a length of one or more blades.

15. The method of claim 13 further comprising:

placing cushioning over at least one outer surface of the container.

16. The method of claim 13, wherein coupling the one or more blades includes inserting a threaded screw, bolt, rivet or any similar fastener through a similarly threaded hole on an outer surface of the container; or using an adhesive, an ultrasonic weld or any similar fusion/welding process to lock the blades in place.

17. The method of claim 13, wherein coupling the one or more blades includes adjustably coupling the blades to the container through a magnet, or a slot or grooves cut across the horizontal length, or vertical width of an outer surface of the container and fastening in place so as to make the blade position adjustable.

18. The method of claim 13 further comprising:

attaching straps to at least one outer surface of the container by a screw, bolt, rivet or any similar fastener inserted through an aligned hole in the outer surface of the container.

19. The method of claim 13, wherein coupling includes coupling two or more blades to two or more outer surfaces of the container.

20. An athletic activity transition device comprising:

means for obtaining a container suitable for athletic activity transition device;

means for waterproofing the container; and means for coupling one or more blades suitable for holding athletic equipment to one or more outer surfaces of the container.

21. The athletic activity transition device of claim 20 further comprising:

means for adjusting a coupling angle and a length of one or more blades.

22. The athletic activity transition device of claim 20 further comprising:

means for placing cushioning over at least one outer surface of the container.

23. The athletic activity transition device of claim 20, wherein means for coupling the one or more blades includes means for placing the one or more blades in a fixed position relative to the container to lock the blades in place.

24. The athletic activity transition device of claim 20, wherein means for coupling the one or more blades includes means for adjustably coupling the blades relative to the container so as to make a position adjustable.

25. The athletic activity transition device of claim 20 further comprising:

means for attaching straps to at least one outer surface of the container.

What is claimed is:

1. An athletic activity transition device, comprising:

a container, wherein the container comprises a top surface, a bottom surface, and one or more side surfaces;

one or more concave recessed areas, wherein the one or more concave recessed areas are defined in the one or more side surfaces such that the one or more concave recessed areas are exposed on the athletic activity transition device; and one or more blades, wherein each of the blades has a proximate end and a distal end, wherein the proximate end is coupled to the one or more side surfaces of the container and the distal end is free, such that each of the blades is disposed within the concave recessed areas; and wherein the container further comprises straps coupled to the one or more side surfaces of the container.

2. The transition device of claim 1, wherein the container is a rigid, hard shell container.

3. The transition device of claim 1, wherein the one or more blades are configured to receive athletic equipment, such that the athletic equipment is at least partially disposed in the one or more concave recessed areas.

4. The transition device of claim 1, wherein the one or more blades are removable from the container and the one or more blades are adjustably coupled to the one or more side surfaces of the container.

5. The transition device of claim 1, wherein two or more blades are positioned on each of the one or more side surfaces of the container.

6. An athletic activity transition device, comprising:

a container, wherein the container comprises a top surface, a bottom surface, one or more side surfaces, and straps, wherein the straps are coupled to the one or more side surfaces;

one or more concave recessed areas, wherein the one or more concave recessed areas are defined in the one or more side surfaces such that the one or more concave recessed areas are exposed on the athletic activity transition device; and one or more blades, wherein each of the blades has a proximate end and a distal end, wherein the proximate end is coupled to the one or more side surfaces of the container and the distal end is free, such that each blade is disposed within the concave recessed areas.

7. The transition device of claim 6, wherein a lid is coupled to one or more surfaces selected from the top surface, the bottom surface, and the one or more side surfaces.

8. The transition device of claim 6, wherein one or more removable partitions divide an interior space, wherein said interior space is defined by the top surface, the bottom surface, and the one or more side surfaces.

9. An athletic activity transition device, comprising:

a container, wherein the container comprises a top surface, a bottom surface, and one or more side surfaces;

one or more concave recessed areas, wherein the one or more concave recessed areas are defined in the one or more side surfaces such that the one or more concave recessed areas are exposed on the athletic activity transition device; and one or more blades, wherein each of the blades has a proximate end and a distal end, wherein the proximate end is coupled to the one or more side surfaces of the container and the distal end is free, such that each of the blades is disposed within the concave recessed areas;

wherein the container further comprises straps coupled to the one or more side surfaces of the container;

wherein the container is a rigid, hard shell container;

wherein the one or more blades are configured to receive athletic equipment, such that the athletic equipment is at least partially disposed in the one or more concave recessed areas;

wherein the one or more blades are removable from the container and the one or more blades are adjustably coupled to the one or more side surfaces of the container; and wherein two or more blades are positioned on each of the one or more side surfaces of the container.

* * * * *